US008839514B2

(12) United States Patent
Scharf

(10) Patent No.: US 8,839,514 B2
(45) Date of Patent: Sep. 23, 2014

(54) METHOD FOR MACHINING, IN PARTICULAR FOR MECHANICAL MACHINING, OF AT LEAST ONE EXHAUST-GAS-CONDUCTING SURFACE REGION OF AN INTERNAL COMBUSTION ENGINE OR CRANKCASE PART, INTERNAL COMBUSTION ENGINE CRANKCASE AND CYLINDER SLEEVE

(75) Inventor: Peter Scharf, Nuremberg (DE)

(73) Assignee: MAN Truck & Bus AG, Munich (DE)

( * ) Notice: Subject to any disclaimer, the term of this patent is extended or adjusted under 35 U.S.C. 154(b) by 177 days.

(21) Appl. No.: 13/273,702

(22) Filed: Oct. 14, 2011

(65) Prior Publication Data

US 2012/0090570 A1 Apr. 19, 2012

(30) Foreign Application Priority Data

Oct. 14, 2010 (DE) ..... 10 2010 048 550

(51) Int. Cl.

| | |
|---|---|
| ***B05C 11/00*** | (2006.01) |
| ***B21K 3/00*** | (2006.01) |
| ***B24B 1/00*** | (2006.01) |
| ***F02B 77/04*** | (2006.01) |
| ***B24B 57/02*** | (2006.01) |
| ***F02F 1/00*** | (2006.01) |
| ***B24B 33/02*** | (2006.01) |
| ***C23F 11/00*** | (2006.01) |
| ***B24B 5/36*** | (2006.01) |

(52) U.S. Cl.

CPC . *B24B 57/02* (2013.01); *B24B 1/00* (2013.01); *F02B 77/04* (2013.01); *F02F 1/00* (2013.01); *B24B 33/02* (2013.01); *C23F 11/00* (2013.01); *B24B 5/36* (2013.01)

USPC ..... 29/888.01; 29/527.2; 118/76; 123/193.2; 427/344

(58) Field of Classification Search

CPC ..... B05F 5/08; B24B 1/00; B24B 33/08; C10M 103/04; C10M 105/76; C10N 2230/56; C10N 2240/10; C23C 24/02; C23C 24/04; F02F 1/20

USPC ..... 29/90.01, 592, 888.01; 92/169.1; 118/76; 123/193.2; 427/344, 399

See application file for complete search history.

(56) References Cited

U.S. PATENT DOCUMENTS 4,956,205 A * 9/1990 Enomoto et al. ..... 427/299
6,828,033 B1 * 12/2004 Bancroft et al. ..... 428/469

(Continued)

FOREIGN PATENT DOCUMENTS

DE 10 2007 017 977 A1 6/2008

*Primary Examiner* — Alexander P Taousakis

(74) *Attorney, Agent, or Firm* — Laurence A. Greenberg; Werner H. Stemer; Ralph E. Locher

(57) ABSTRACT

A method for machining, in particular mechanical machining, of at least one exhaust-gas-conducting surface region of an internal combustion engine or crankcase part, in particular at least one cylinder barrel of a crankcase or at least one cylinder barrel of a cylinder sleeve, includes using a surface-condition-changing machining tool. The surface region is produced from a corrodible material and is brought into contact, during the machining through the use of the surface-condition-changing machining tool, with at least one tribochemically activatable substance being activated during the machining in particular as a function of a defined contact pressure of the machining tool and/or as a function of a defined machining temperature, and forms a corrosion-resistant surface as a triboreaction layer with the respective surface region, by tribochemical reaction. A crankcase and a cylinder sleeve formed in this way are also provided.

10 Claims, 1 Drawing Sheet

(56) References Cited

U.S. PATENT DOCUMENTS

| | | | | |
|---|---|---|---|---|
| 6,881,451 | B2 * | 4/2005 | Heinemann et al. | 427/554 |
| 2002/0153359 | A1 * | 10/2002 | Feikus | 219/121.6 |
| 2004/0042697 | A1 * | 3/2004 | Woydt et al. | 384/278 |
| 2004/0086701 | A1 * | 5/2004 | Brinkschroeder et al. | 428/293.1 |
| 2010/0272931 | A1 * | 10/2010 | Stavlid | 428/34.1 |
| 2013/0104357 | A1 * | 5/2013 | Zhmud | 29/90.01 |
| 2013/0199482 | A1 * | 8/2013 | Langston et al. | 123/1 A |

* cited by examiner

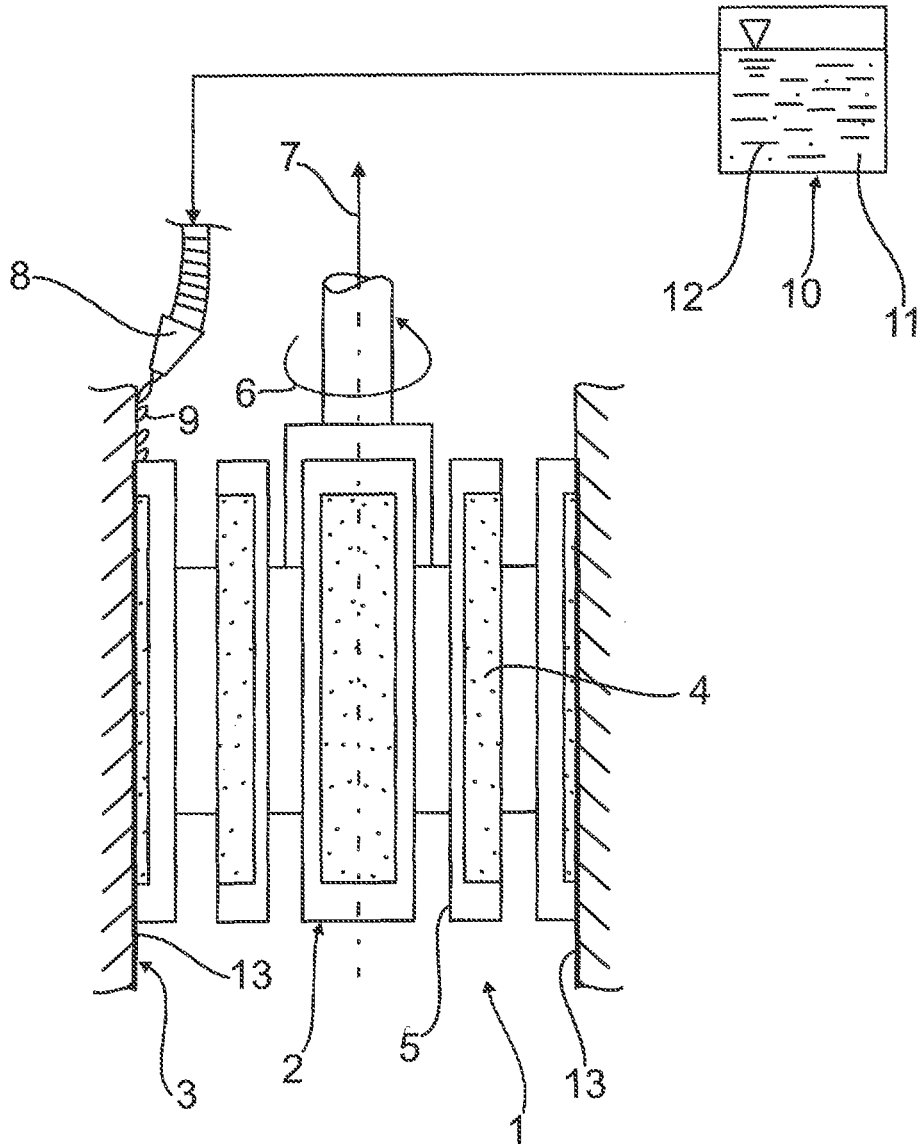
7
8
12
10
11
6
9
4
13
3
2
5
1
13

METHOD FOR MACHINING, IN PARTICULAR FOR MECHANICAL MACHINING, OF AT LEAST ONE EXHAUST-GAS-CONDUCTING SURFACE REGION OF AN INTERNAL COMBUSTION ENGINE OR CRANKCASE PART, INTERNAL COMBUSTION ENGINE CRANKCASE AND CYLINDER SLEEVE

CROSS-REFERENCE TO RELATED APPLICATION

This application claims the priority, under 35 U.S.C. §119, of German Patent Application DE 10 2010 048 550.1, filed Oct. 14, 2010; the prior application is herewith incorporated by reference in its entirety.

BACKGROUND OF THE INVENTION

Field of the Invention

The invention relates to a method for the machining, in particular for the mechanical machining, of at least one exhaust-gas-conducting surface region of an internal combustion engine or crankcase part, in particular for the machining of at least one cylinder barrel of an internal combustion engine crankcase or for machining at least one cylinder barrel of a cylinder sleeve, through the use of a surface-condition-changing machining tool. The invention also relates to an internal combustion engine crankcase having at least one exhaust-gas-conducting surface region, in particular having at least one cylinder barrel. The invention additionally relates to a cylinder sleeve having at least one cylinder barrel.

Crankcases of internal combustion engines are generally known. They serve for mounting the crankshaft and have cylinders with cylinder barrels in which the pistons of the internal combustion engines are guided. During the operation of internal combustion engines with fuel having a high sulfur content, in conjunction with exhaust-gas recirculation, aggressive media can be formed, for example sulfur oxides and nitrogen oxides, which form aggressive acids, for example sulfuric acid, with condensed water. The aggressive media or acids have a corrosive action in the exhaust-gas-conducting components of an internal combustion engine crankcase produced from a corrodible material, for example in the region of cylinder barrels of an internal combustion engine crankcase. Destruction of the surface regions of the cylinder barrels therefore occurs, leading ultimately to damage thereto or destruction thereof which, as is known, has an adverse effect on the internal combustion engine operation overall. The same applies in principle to cylinder barrels formed by cylinder sleeves, also referred to as cylinder liners, which are inserted or cast into the crankcase.

It is also generally known, for example from German Published Patent Application DE 10 2007 017 977 A1, for the cylinder barrels of an internal combustion engine crankcase to be mechanically finely machined by honing in order to generate good sliding properties between the piston and the cylinder barrel. Such complexly finely machined surfaces are, however, destroyed by the above-described acidic action during the operation of the internal combustion engine with sulfur-containing fuel, and quickly lead to a need for reworking of the cylinder barrels, which is clearly expensive and complex.

In order to counteract such a corrosive action by aggressive acids, gases and condensates it is, for example, possible for the conventional cast iron materials or steels to be coated with less corrodible materials, for example with iron-chromium alloys which, however, leads to a considerable increase in overall costs of the internal combustion engine crankcase or cylinder sleeves.

SUMMARY OF THE INVENTION

It is accordingly an object of the invention to provide a method for the machining, in particular for the mechanical machining, of at least one exhaust-gas-conducting surface region of an internal combustion engine or crankcase part, in particular for the machining of at least one cylinder barrel of an internal combustion engine crankcase or for machining at least one cylinder barrel of a cylinder sleeve, which overcomes the hereinafore-mentioned disadvantages of the heretofore-known methods of this general type and through the use of which method the at least one exhaust-gas-conducting surface region can be reliably protected against corrosion in a simple and functionally reliable manner, in particular reliably protected against engine-internal corrosion. It is a further object of the present invention to provide an internal combustion engine crankcase and/or a cylinder sleeve having at least one exhaust-gas-conducting surface region, in particular at least one cylinder barrel, which is reliably protected against corrosion by aggressive media.

With the foregoing and other objects in view there is provided, in accordance with the invention, a method for the machining, in particular for the mechanical machining, of at least one exhaust-gas-conducting surface region of an internal combustion engine or crankcase part, in particular for the machining of at least one cylinder barrel of an internal combustion engine crankcase or for machining at least one cylinder barrel of a cylinder sleeve, using a surface-condition-changing machining tool. The method comprises bringing at least one exhaust-gas-conducting surface region, in particular at least one cylinder barrel of a crankcase or of a cylinder sleeve produced from a corrodible material, into contact, during the course of the machining using the surface-condition-changing machining tool, with at least one tribochemically activatable substance being activated during the course of the machining, in particular as a function of a defined contact pressure of the machining tool and/or as a function of a defined machining temperature generated during the machining, and forming a corrosion-resistant surface as a triboreaction layer with the respective surface region by tribochemical reaction.

With the objects of the invention in view, there is also provided an internal combustion engine crankcase, comprising at least one exhaust-gas-conducting surface region, in particular having at least one cylinder barrel, the surface region having a corrosion-resistant surface formed by the method according to the invention.

With the objects of the invention in view, there is furthermore provided a cylinder sleeve, comprising at least one cylinder barrel having a corrosion-resistant surface formed by the method according to the invention.

It is thereby possible to advantageously eliminate complex coating processes subsequently to the production of the respective component, and the use of expensive, corrosion-resistant materials. In fact, with the present invention, it is possible for a corrosion-resistant surface to be formed through the use of a simple tribochemical reaction during the course of the surface-condition-changing machining, which takes place in any case, of the exhaust-gas-conducting surface regions.

According to the invention, the surface which is corrosion-resistant with respect to aggressive acids, gases and condensates, such as can arise during the operation of internal combustion engines with exhaust-gas recirculation and sulfur-containing fuel, is therefore generated not retroactively or during operation of the internal combustion engine, but rather is already generated before that, integrally or simultaneously with the surface-condition-changing machining of the respective component during the production thereof.

It is basically possible to use any machining tool through the use of which it is possible to attain the formation, according to the invention, of a triboreaction layer, for example even thermally acting machining processes such as for example laser honing, as long as they do not result in evaporation of the tribochemically activatable substance. The surface-condition-changing machining tool is, however, preferably a mechanical machining tool, preferably a chip-removing and/or chip-forming machining tool, through the use of which the at least one exhaust-gas-conducting surface region, in particular the at least one cylinder barrel, is mechanically machined and changed with regard to the surface condition. In this case, the terms "chip-removing" and "chip-forming" machining are expressly intended to be understood in a broad sense and to encompass any mechanical machining in which the machined surface is changed and thereby provided with a certain shape, whether that be through the use of a geometrically specified or through the use of a geometrically unspecified cutting edge.

It is particularly preferable for the mechanical machining tool to be a honing tool through the use of which the at least one exhaust-gas-conducting surface region, in particular the cylinder barrels, is honed, wherein all honing processes may be used individually or in combination. Honing regularly constitutes the final machining stage during the production of the internal combustion engine crankcase, in particular for dimensionally accurately forming the cylinder bore and therefore the cylinder barrels of the crankcase. Through the use of honing, it is ensured that for example the cylinder barrels of the crankcase have the desired oil retention capacity, because the honed surfaces have crossed machining scores.

Furthermore, during the course of a mechanical machining process, the contact of the tool with the surface to be machined ensures that high reaction energies arise, in particular with regard to a contact pressure and/or a machining temperature. The high reaction energies lead to the activation of the tribochemically activatable substance and can thereby form the corrosion-resistant surface as a triboreaction layer. It is thereby possible for the high contact pressures and temperatures which arise in any case during the course of the mechanical machining to be advantageously utilized to activate the tribochemically activatable substance, in such a way that the latter forms a corrosion-resistant surface with the respective surface region.

In this case, the tribochemically activatable substance may, on one hand, be applied directly to the surface to be machined before and/or during the machining through the use of the respective machining tool, for example as a solid layer or as a sprayed layer, wherein the tribochemically activatable substance is then distributed as homogeneously and finely as possible in the respective medium. Alternatively or in addition, the tribochemically activatable substance may, however, also be admixed as an additive to a lubricant to be supplied in any case during the machining, in particular during the mechanical machining. The expression "lubricant" is to be understood herein in a broad sense and is expressly intended to encompass all liquid media which, in conjunction with the in particular mechanical machining, are supplied as an emulsion or the like in the conventional way. In particular, the addition of the tribochemically activatable substance as an additive to a lubricant of that type is particularly easy to realize and ensures in a simple manner that the tribochemically activatable substance passes to precisely the location at which the tribochemical reaction for forming the corrosion-resistant surface should take place.

Metal silicates as well as boron compounds, if appropriate, are particularly suitable as a tribochemically activatable substance. The additive is preferably dissolved or emulsified in a defined quantity in a concentrate. The concentrate is then added to, in particular emulsified in, the lubricant in a concentration of 7 to 15%, preferably approximately 10%, in relation to the amount of lubricant.

As already discussed above, due to the implementation of the method according to the invention, those components of an internal combustion engine which form the exhaust-gas-conducting surface regions, such as for example a crankcase and/or a cylinder sleeve, may be produced from a cost-effective iron material, for example from a corrodible cast iron and/or a corrodible steel.

The advantages obtained in conjunction with an internal combustion engine crankcase with exhaust-gas-conducting surface regions, in particular with cylinder barrels or with a cylinder sleeve, are the same as those already described above with regard to the implementation of the method according to the invention. In this respect, reference is made to the statements made above.

Other features which are considered as characteristic for the invention are set forth in the appended claims.

Although the invention is illustrated and described herein as embodied in a method for the machining, in particular for the mechanical machining, of at least one exhaust-gas-conducting surface region of an internal combustion engine or crankcase part, an internal combustion engine crankcase and a cylinder sleeve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is a fragmentary, diagrammatic, longitudinal-sectional view of a cylinder of a crankcase of an internal combustion engine.

DETAILED DESCRIPTION OF THE INVENTION

Referring now in detail to the single FIGURE of the drawing, there is seen a diagrammatic illustration of a cylinder 1 of a crankcase (which is not illustrated in any further detail herein) of an internal combustion engine. A honing mandrel 2, which is likewise illustrated in a highly diagrammatic manner, is inserted in a cylinder bore of the cylinder in order to carry out fine machining of a cylinder barrel 3 in a manner which is known per se. For this purpose, the honing mandrel 2 has a plurality of honing strips 5 which are distributed over the circumference, carry honing blocks 4 and are spaced apart from one another in the circumferential direction. In this respect, the honing mandrel 2 has a conventional construction. In order to carry out the mechanical fine machining of the cylinder barrel 3, the honing mandrel 2 performs a rotational movement corresponding to an arrow 6 with a feed movement in the direction of an arrow 7, in order to produce a cylinder barrel 3 with the desired non-illustrated honing scores.

Through the use of a lubricant nozzle 8, which is merely highly diagrammatically illustrated herein, during the course of the mechanical honing fine machining through the use of the honing mandrel 2, a lubricant 9 is introduced into the cylinder bore and thereby applied to the cylinder barrel 3 as is merely highly diagrammatically illustrated and by way of example in the FIGURE. The lubricant 9, which is supplied in this case, is extracted from a lubricant reservoir 10 which is likewise merely highly diagrammatically illustrated in the single FIGURE. In this case, the lubricant 9 is composed of a base lubricant emulsion 12 in which a tribochemically activatable additive 11, for example a metal silicate, is emulsified or finely distributed, in such a way that the cylinder barrel 3 is wetted with the tribochemically activatable additive during the course of the mechanical fine machining through the use of the honing mandrel 2. During the further course of the mechanical honing machining, the tribochemically activatable additive is activated due to the high contact pressure of the honing mandrel 2 prevailing in the respective honing region and due to the relatively high machining temperature prevailing in the honing region, and the tribochemically activatable additive thereby forms, with the mechanically finely machined surface region of the cylinder barrel 3, a corrosion-resistance surface 13, which is indicated herein merely very much by way of example and diagrammatically, as a triboreaction layer. The latter serves to provide excellent engine-internal corrosion protection against aggressive acids, gases, condensates and the like such as can arise, in particular, during the operation of internal combustion engines with exhaust-gas recirculation and sulfur-containing fuel.

The crankcase itself and therefore the cylinder barrels 3 are preferably produced, before the machining thereof, for example from a cast iron material.

The invention claimed is:

1. A method for protecting at least one exhaust-gas-conducting surface region of an internal combustion engine or crankcase part against corrosion, the method comprising the following steps:

machining at least one exhaust-gas-conducting surface region produced from a corrodible material using a surface-condition-changing machining tool;

bringing the at least one exhaust-gas-conducting surface region into contact, during the machining, with at least one tribochemically activatable substance being activated during the machining;

protecting the at least one exhaust-gas-conducting surface region against corrosion by forming a corrosion-resistant surface as a triboreaction layer with the respective surface region, by tribochemical reaction;

carrying out the machining step by mechanically machining and changing the at least one exhaust-gas-conducting surface region with regard to surface condition using a mechanical machining tool as the surface-condition-changing machining tool;

adding the tribochemically activatable substance as an additive to a lubricant and supplying the lubricant during the mechanical machining; and forming the tribochemically activatable substance of at least one metal silicate.

2. The method according to claim 1, which further comprises carrying out the machining step by mechanical machining.

3. The method according to claim 1, which further comprises providing at least one cylinder barrel of an internal combustion engine crankcase or at least one cylinder barrel of a cylinder sleeve as the at least one exhaust-gas-conducting surface region.

4. The method according to claim 1, which further comprises activating the at least one tribochemically activatable substance as a function of at least one of a defined contact pressure of the machining tool or a defined machining temperature generated during the machining.

5. The method according to claim 1, which further comprises providing at least one of a chip-removing or chip-forming machining tool as the surface-condition-changing machining tool.

6. The method according to claim 1, which further comprises providing a honing tool as the surface-condition-changing machining tool.

7. The method according to claim 1, which further comprises applying the tribochemically activatable substance directly to the surface to be mechanically machined at least one of before or during the machining carried out by using the machining tool.

8. The method according to claim 1, which further comprises applying the tribochemically activatable substance directly to the surface to be mechanically machined at least one of before or during the machining carried out by using the machining tool, and adding the tribochemically activatable substance as an additive to a lubricant supplied during the mechanical machining.

9. The method according to claim 1, wherein the crankcase is formed of a material selected from the group consisting of an iron material, a corrodible cast iron and a corrodible steel.

10. The method according to claim 1, which further comprises producing the triboreaction layer in a final machining step before finishing the part.

* * * * *